US005452763A

United States Patent [19]

Owen

[11] Patent Number: 5,452,763

[45] Date of Patent: Sep. 26, 1995

[54] METHOD AND APPARATUS FOR GENERATING GAS IN A DRILLED BOREHOLE

[75] Inventor: Thomas E. Owen, Helotes, Tex.

[73] Assignee: Southwest Research Institute, San Antonio, Tex.

[21] Appl. No.: 303,601

[22] Filed: Sep. 9, 1994

[51] Int. Cl.[6] ..... E21B 43/26

[52] U.S. Cl. ..... 166/259; 166/63; 166/271; 204/228

[58] Field of Search ..... 166/259, 260, 166/271, 307, 308, 63, 127, 131; 204/228

[56] References Cited

U.S. PATENT DOCUMENTS

| | | | |
|---|---|---|---|
| 3,422,760 | 1/1969 | Mohaupt | 166/63 X |
| 4,379,043 | 4/1983 | Chappelle | 204/229 |
| 4,945,984 | 8/1990 | Price | 166/271 X |
| 4,976,318 | 12/1990 | Mohaupt | 166/63 X |
| 5,229,977 | 7/1993 | Owen | 367/145 |
| 5,295,393 | 3/1994 | Thiercelin | 166/271 X |
| 5,396,951 | 3/1995 | Ross | 166/63 |

*Primary Examiner*—Ramon S. Britts
*Assistant Examiner*—Frank S. Tsay
*Attorney, Agent, or Firm*—Gunn, Lee & Miller

[57] ABSTRACT

The present apparatus and method utilizes a downhole electrolysis process implemented by means of an elongated gas generating apparatus containing an array of cascaded electrolysis cells distributed along all or part of the borehole length to be fractured. In one use of the present invention in a deep or a shallow drilled borehole, an electrical current delivered downhole converts an appropriate electrolyte to a stoichiometric mixture of combustible gases, such as, oxygen and hydrogen, which is ignited when sufficient gases have been collected to achieve the desired explosive force in the area surrounding the drilled borehole. In another use of the present invention, the gases are not ignited but rather at least one of the generated gases are delivered by pressure into the area surrounding the drilled borehole to enhance environmental remediation processes.

26 Claims, 8 Drawing Sheets

METHOD AND APPARATUS FOR GENERATING GAS IN A DRILLED BOREHOLE

BACKGROUND OF THE INVENTION

1. Field of the Invention

The present invention relates to apparatuses for generating gases in drilled boreholes and methods of using these apparatuses. One of the apparatuses can be used to explosively fracture a vertical or horizontal deep drilled borehole below the water table and another of the apparatuses can be used to enhance the permeability of soil in the area or to generate remediation gases in contaminated soil adjacent to a vertical shallow drilled borehole above the water table.

2. Background Information

The production of oil and gas from geological reservoir formations in the earth is dependent upon the fluid permeability of those formations whereby the hydrocarbon liquid or gas can migrate into the producing wells to be recovered. In many reservoir formations, the natural permeability of the porous rock and/or the presence of natural tectonic fractures is sufficient to allow good production of the hydrocarbon liquid and/or gas. Other formations are known to contain the oil or gas in compartmentalized geological structures which are not interconnected and, hence, cannot be produced without drilling additional wells or otherwise disrupting the restraining compartments adjacent to existing wells. Still other formations are known to hold their oil or gas resource primarily in faults and fractures in otherwise low porosity rock formations and, hence, the producing drill hole must physically intercept these faults and fractures in order to recover the oil or gas.

In those cases where the drill hole fails to intercept the reservoir oil or gas storage compartment or fault or fracture zone, the geological materials surrounding the drill hole may be artificially fractured to facilitate fluid flow connections between the hydrocarbon storage zones and the drilled well. The most common technology used for this purpose is one of imposing a relatively high hydraulic pressure in the borehole, usually localized to the depth interval of interest by means of temporarily expandable plugs (packers), which will stress the rock sufficiently to overcome its tensile strength and thereby create fracture cracks which extend radially away from the wellbore axis. By driving the fracture fluid into these cracks, they can be made to grow and extend away from the wellbore and may intercept the oil and gas storage zones of interest. Residual tectonic stresses in the drilled formations have a primary influence on the direction and extent of the hydraulically induced fractures. This latter influence inhibits the ability to select and control the direction and number of fractures that may be created by the hydraulic fracturing process. As a consequence of the existing fracture structure relative to the position of the drilled borehole, the hydraulically induced fractures may or may not extend and intercept the oil or gas storage zone targets of interest.

Further, hydraulic fracturing is not effective in permeable ground where the fluid just dissipates into the ground and is not driven into the fracture cracks. Hydraulic fracturing also does not work well in horizontal wells in ground with many vertical faults because these faults allow the fluid and pressure to escape from the borehole.

Alternative methods of fracturing drilled geological formations have involved the use of solid or plastic explosive materials placed or tamped in the wellbore. The large amount of energy released in an explosive impulse tends to dominate the initiation of cracks in the borehole wall in a manner which can override the influences of the residual tectonic stresses in the formation. Therefore, with the use of these explosives, several induced fractures can be initiated in different directions to offset the directional disadvantage of hydraulic fracturing. The technical disadvantage of explosive fracturing is that the explosive impulse will tend to greatly overstress and to form rubble in the immediate borehole wall with the consequence that excessive energy is expended near the wellbore without useful results. Thus, the resulting fractures do not extend deeply into the formation surrounding the borehole. Moreover, the explosion-driven materials (e.g., gases and granular debris) that do penetrate the newly initiated cracks are not explosively active and, hence, have only a modest influence on the crack growth. Another very significant disadvantage of conventional explosive fracturing is the necessity of handling large amounts of hazardous explosive materials, either solids or gases, at the surface and in the borehole.

A fundamental approach to overcoming the hazards of handling explosive materials, either solid, liquid, or gaseous, is one in which the ingredients of the explosive material are inert when separated and may be combined and mixed at the final location where detonation is desired. Two-component liquid explosives and fuel and oxidant gaseous explosives are appropriate for use in this approach. However, mixing of the final explosive material becomes difficult in a downhole environment where accurate control and intermingling of the separate components is critical to achieving the desired explosive mixture. The optimum energy yield of the explosive reaction requires uniform mixing and stoichiometric composition of the reactive components, making the mixed process of any two-part composition a difficult control problem at the downhole pressure and temperature.

To overcome the various limitations cited above for the hydraulic and conventional explosive fracturing techniques in deep drilled boreholes, a new apparatus and method are needed to fracture these drilled boreholes. The use of the apparatus of the present invention, a gas generating electrolyzer, overcomes all of the problems with the known fracturing methods.

In addition to the use of the apparatus of the present invention in drilled boreholes below the water table, the apparatus can be used in drilled boreholes above the water table to loosen soil and thereby enhance the permeability of contaminated soil around the drilled borehole so that remediation processes will work more efficiently. Further, a modified configuration of this apparatus can be used to generate gases which can be used in a number of different remediation processes.

Environmental remediation processes such as in situ biodegradation via microorganisms, purging of volatile liquid contaminants or their vapors and gases by air sparging, drawing vapors and gases from the ground by vacuum, and either mobilizing or fixating contaminants by injecting solvents or other chemical reagents into the contaminated zone, are potentially effective in breaking down and removing, or arresting the migration of contaminants in soil and other permeable earth materials. The effectiveness of these processes depends upon the ability to introduce and distribute the remediation agent into the contaminated zone so as to promote the degradation or removal of the contaminant. How readily the contaminant enters the formation is dependent upon the porosity and permeability of the contaminated ground. If the porosity and permeability are low, an extended time period is required for the contaminant to diffuse away from its source. Remediation of such zones of contamination can be accelerated if the remediation agent, for example, a colony of biodegrading microorganisms appropriately selected to break down or consume the contaminant in situ, can be more easily introduced into the contaminated zone. A common and direct approach to facilitating such remediation access is to drill injection boreholes and return ventilation boreholes into the suspected subsurface contaminated zone so that the treatment mechanism can be placed in direct contact with the contaminant. However, even with this means of direct access, the diffusion of the remediation process is generally dependent upon the same natural permeability of the ground that permitted the original contaminant diffusion.

There is an important need to improve the effectiveness of such in situ remediation processes. There is also a need to improve the effectiveness of air sparging of contaminated soil. The apparatus of the present invention can effectively loosen the compaction or cementation of granular soil particles surrounding a soil borehole above the water table and thereby enhance the permeability of the contaminated zone of access around the borehole.

The use of prior art hydraulic fracturing techniques in shallow boreholes drilled in soil or other unconsolidated material would be of limited value since the static pressure needed to produce yielding stresses in the surrounding soil cannot generally be attained because of the existing natural permeability of most soils. The use of the prior art explosive fracturing techniques in soil boreholes is also of limited value because of the difficulty in controlling the localized stresses around the exploding charge which can cause excessive yield in the surrounding soil, resulting in local absorption of the impulsive overpressure needed to loosen the granular materials at larger radial distances away from the borehole. Further, both of these prior art methods introduce additive material into the soil. The explosive fracturing method requires specialized handling of the explosive materials and imposes potential safety hazards in its use.

The disclosed invention is a gaseous combustion technique that overcomes the disadvantages associated with the prior art hydraulic and explosive fracturing techniques described above.

The apparatus of the present invention can be used in similar methods to produce gases in drilled boreholes above and below the water table. Both methods provide advantages which include controllability of the combustion energy and the impulsive overpressure applied to the borehole wall, uniform distribution of the impulsive pressure along the borehole depth zone of interest, generation of only pure water as the combustion product after each reaction, and safe operation because no hazardous materials are handled.

Additional advantages of the method of using the apparatus of the present invention in deep drilled boreholes below the water table are introducing multiple fracture cracking into the borehole wall independently of residual stress directions in the formation and delivering active fracture growth forces to pre-existing and induced fractures of the borehole wall.

Additional advantages of the method of using the apparatus of the present invention in shallow drilled boreholes above the water table are providing repetitive impulsive pressurization of the borehole without requiring new or additional materials to be introduced into the borehole between each pressure impulse and permeating the pores of the soil with the gaseous combustion components to cause more effective loosening of the material upon combustion.

SUMMARY OF THE INVENTION

The present invention provides a novel apparatus for and a method of explosively fracturing deep drilled boreholes below the water table.

The present invention also provides a novel apparatus for and a method to deliver active fracture growth forces to induced as well as pre-existing fractures in deep drilled borehole walls.

The present invention further provides a novel apparatus for and a method of enhancing the permeability of soil in an area surrounding shallow drilled boreholes above the water table thus increasing the effectiveness of environmental remediation processes.

The present invention further provides a novel apparatus for and a method to generate a number of different gases, including oxygen and hydrogen, which promote subsurface soil remediation in the area surrounding a shallow drilled borehole above the water table.

The present invention further provides a safe method of placing gaseous explosive material into both shallow and deep drilled boreholes.

The present apparatus and method utilizes a downhole electrolysis process implemented by means of an elongated gas generating explosive apparatus containing an array of cascaded electrolysis cells distributed along all or part of the borehole length to be fractured. In one use of the present invention in a deep or a shallow drilled borehole, an electrical current delivered downhole converts an appropriate electrolyte to a stoichiometric mixture of combustible gases, such as oxygen and hydrogen, which is ignited when sufficient gases have been collected to achieve the desired explosive force in the area surrounding the drilled borehole. In another use of the present invention, the gases are not ignited but rather at least one of the generated gases are delivered by pressure into the area surrounding the drilled borehole to enhance remediation processes.

DETAILED DESCRIPTION OF THE PREFERRED EMBODIMENT

Figure 1:
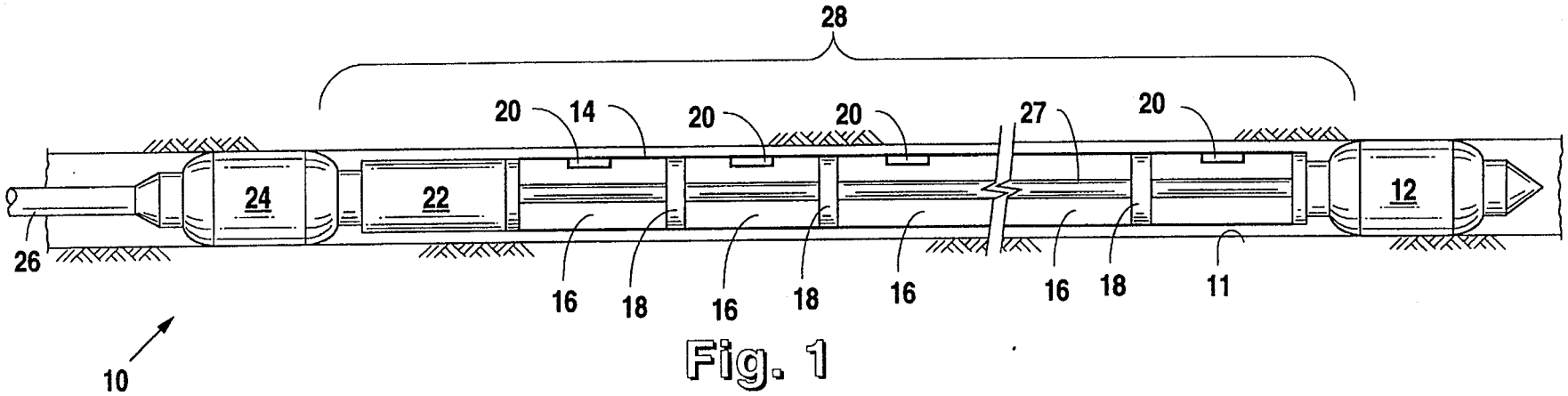
FIG. 1 illustrates a cross-sectional view of the apparatus of the present invention for use in a deep drilled horizontal borehole.

The present apparatus and method utilizes a downhole electrolysis process implemented by means of an array of cascaded electrolysis cells distributed along all or part of the borehole length to be fractured to generate a stoichiometric mixture of combustible gases, such as a mixture of oxygen and hydrogen. Cascading the electrolysis cells allows the downhole electrical system to operate at relatively high voltage and relatively low current to minimize the power losses in the electrical cable that delivers electrical power downhole. In deep drilled boreholes below the water table, a large number of electrolysis cells may be connected in an electrical series circuit to allow the current flowing through the cells to actively generate oxygen on one side of each electrode and hydrogen on the opposite side. These gases are produced in stoichiometrically balanced proportions and commingle in the vicinity of each electrode since no partitions are used to segregate the two species of gases. The amount of time required to create the gaseous explosive mixture in the borehole depends upon the volume of the borehole length to be fractured, the hydrostatic pressure at the depth of the electrolysis cells, and the electrical power delivered downhole.

The gaseous explosive mixture consists of oxygen and hydrogen gases produced by electrolysis of an appropriate aqueous electrolyte. In this case, the electrolysis process is an inherently precise means for generating stoichiometric mixtures of oxygen and hydrogen relatively independent of the downhole temperature and pressure conditions imposed on the process. Furthermore, oxygen-hydrogen mixtures offer the highest energy density of any available gaseous explosive and, hence, when coupled with the precision downhole electrolysis generation of stoichiometric composition, is the preferred explosive.

The energy required to generate the oxygen and hydrogen gas components is delivered downhole in electrical form; a safe and practical source of primary energy. The electrolysis process can be viewed as one of converting the input electrical energy to chemical potential energy stored in the accumulated oxygen and hydrogen gas constituents.

One of the methods of using the apparatus of the present invention is for the gaseous explosive fracturing of deep drilled geologic formations below the water table by using a novel means for producing practical high-energy explosive fracturing effects in oil and gas reservoir rocks. This method does not require the handling of any hazardous materials or igniters at any time during the borehole fracturing operation. The gaseous explosive material generation and placement in the drilled borehole to be fractured involves only the delivery of electrical energy downhole to the array of cascaded electrolysis cells where an optimum mixture of oxygen and hydrogen is produced and later ignited in place.

Oxygen and hydrogen gases produced by the electrolysis cells of the present invention form an inherently accurate and self-governing means of producing a stoichiometric gaseous explosive mixture which has the highest available heat energy of combustion of all gaseous mixtures. The explosive gas mixture provided by the downhole electrolysis process evolves at the hydrostatic pressure in the borehole fluid. This pressurized gas mixture will migrate into existing fractures intersecting the borehole. Ignition of the bulk volume of gas in the borehole will expand the gas-filled existing fractures allowing the combustion flame front to ignite the gas in the fracture apertures.

Another method of using the disclosed invention is in shallow drilled boreholes by providing an effective means for in situ environmental remediation treatment processes to permeate contaminated soil or other geological formations. The relevant remediation processes to which this technique is applicable include biodegradation via microorganisms, purging of volatile liquid contaminants or their vapors and gases by air sparging, drawing vapors and gases from the ground by vacuum, and either mobilizing or fixating contaminants by injecting solvents or other chemical reagents into the contaminated zone.

This method of the invention operates to enhance the permeability of the ground by combustion of a stoichiometric mixture of hydrogen and oxygen in an uncased borehole to produce a transient pressure impulse which loosens the granular structure of the contaminated formation in which the hole is drilled.

This method of the invention can also be utilized in a similar manner, as an in-hole oxygen-hydrogen gas generation technique, but without applying the steps of ignition and combustion of the gas mixture. Further, different electrolytes and electrode materials can be employed in the electrolysis gas generating process for the purpose of producing gases other than oxygen and hydrogen. In this application of the present invention, as for example when using the same aqueous electrolyte solution as that described for producing oxygen and hydrogen gases, the oxygen and hydrogen gases are, instead, generated in a manner by which they are kept separated. Thus, the technique is one of providing a convenient and controllable means for generating either oxygen or hydrogen directly in the borehole. With one or more packers installed to close off and isolate either one of the evolved gases within a preferred depth interval in the borehole or with an electrolyzer containing alternating gas separating membranes, one species of gas may be retained downhole for use in benefiting the subsurface remediation process while the other gas may be delivered and collected or vented at the surface.

A principal use of this technique is the pressurization of the borehole with oxygen so that the oxygen is forced to invade the drilled permeable soil or other material surrounding the borehole and the hydrogen is delivered out of the borehole to the surface. By causing the oxygen to invade the contaminated volume of ground around the borehole, certain organic compounds which have migrated into and contaminated the ground will be oxidized to become more accessible to natural in situ degradation and, as a result, also become less reactive or toxic as an environmental pollutant.

Another purpose of forcing oxygen to invade the contaminated ground around the borehole is to furnish oxygen as a nutrient for the growth of certain microorganisms whose presence and function is to digest or otherwise take up or decompose the contaminating materials in the soil.

The concept described above wherein the electrolysis process is used to generate oxygen and hydrogen in the borehole for permeation into the contaminated formation with no combustion may be generalized to provide an in situ means for producing other gases that are also beneficial in promoting subsurface soil remediation processes. Various evolved gases may be generated by the electrolysis of different aqueous solutions and include such gases as carbon dioxide (useful as a solvent of hydrocarbon contaminants) and methane (useful as a nutrient for certain microorganisms). In situ electrolysis generation of other gaseous compounds (by utilizing certain preferred electrolyte solutions and electrode materials in the electrolysis cell) will provide a convenient and economical source of those gases for specified reaction with the contaminants present. Some of the chemical reactions of interest include those which will dissolve the contaminant, reduce the viscosity of the contaminant, precipitate all or part of the contaminant, and solidify or otherwise fix the contaminant in place.

In any of the above applications of in situ gas generation in a shallow drilled borehole above the water table, the desired gas produced and pressurized in the borehole for invasion into the surrounding formation may be aided in its injection into the formation by pressurized air delivered downhole from an air compressor or other source located at the surface. Such supplemental provision of pressurized air downhole will serve either to dilute the beneficial gas evolved by the electrolysis process to a preferred concentration, for example, to achieve the optimum nutrient concentration needed for the growth of certain bioremediation microorganisms or simply to provide a supplemental carrier gas to drive the beneficial gas farther and/or faster into the porous formation as a result of the higher air pressure and flow rate available.

The above concepts related to in situ environmental remediation are important to problems in which subsurface contamination of soil or other geological materials may be treated by injecting gases or gaseous compounds. In-place electrolysis generation of the desired gases for this purpose is an economical means for implementing this gas treatment process for long-term or semi-permanent application to the subsurface contaminated zones of concern. Moreover, this process, when used in combination with and preceded by the previously described oxygen-hydrogen combustion technique for enhancing the permeability of the contaminated formation, can provide a still further advantageous capability which will reduce the cost of site preparation and improve the cost effectiveness of the treatment process applied to removal of undesirable contaminants or pollutants.

In discussing the apparatus and methods of the present invention in detail with reference to the figures, the components will be identified as they relate to the first end and to the second end of the apparatus. As oriented when the apparatus is placed in the drilled borehole, the first end of the apparatus is the lower end which is closest to the bottom of the drilled borehole and the second end of the apparatus is the upper end which is the end closest to the top of the drilled borehole.

Figure 2:
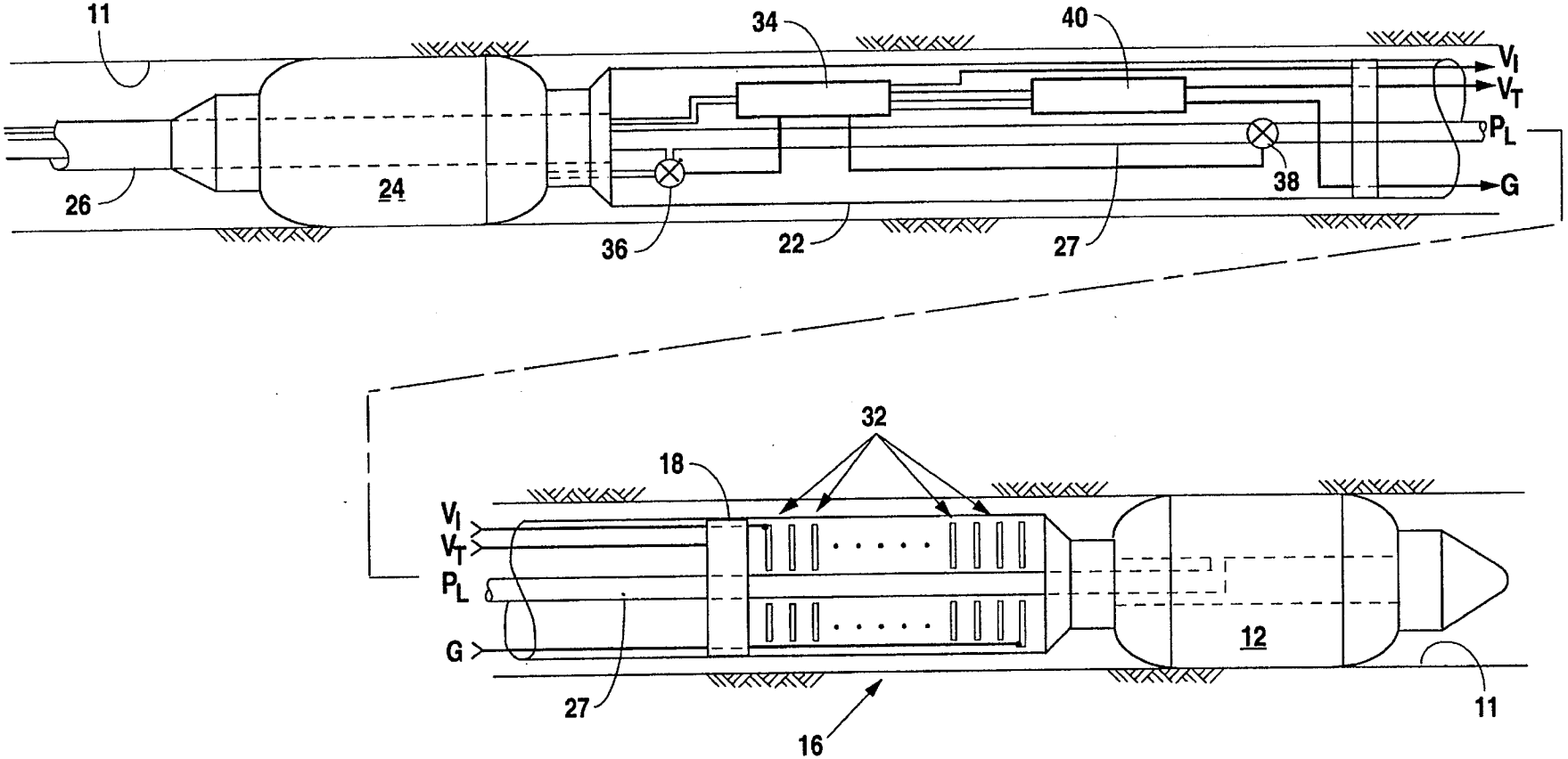
FIG. 2 illustrates a partial cross-sectional detailed view of the apparatus of the present invention for use in a deep drilled horizontal borehole.

FIGS. 1 and 2 illustrate the elongated gas generating apparatus (10) of the present invention for use in a horizontal deep drilled borehole (11) below the water table. The apparatus comprises a lower packer (12) which is attached to a first end of the apparatus; an upper packer (24) attached to a second end of the apparatus; an electrolyte containment sleeve (14) extending intermediate the first end and the second end; at least one elongated electrolysis cell (16) disposed within the sleeve which is capable of producing a stoichiometric mixture of combustible gases by electrolysis of an aqueous electrolyte retained within the sleeve; at least one ignition means (18) for igniting the mixture of gases; a gas releasing means consisting of at least one disrupter (20) affixed to or present within the sleeve (14) for allowing the combustible gases to be discharged from the sleeve (14) into the drilled borehole (11); and a multipurpose suspension cable (26) attached to the second end of the apparatus for supplying electrical power for electrolysis, for energizing of the ignition means (18), and for the operation of and for the supply of hydraulic fluid to the upper (24) and lower (12) packers. A control module (22) containing hydraulic and electrical control means, an igniter power supply and an igniter trigger circuit is located between the upper packer (24) and the electrolyte containment sleeve (14).

The lower (12) and upper (24) packers are standard packers used in drilled oil wells. They are made of a flexible, durable material, such as rubber or plastic or a polymeric material which can be deflated and inflated. The packers are deflated when the apparatus is placed in the drilled borehole and inflated with hydraulic fluid or oil from the surface of the ground at the appropriate time via the control module (22). The hydraulic supply function of the multipurpose suspension cable (26) extends from the control module (22) through the middle of the containment sleeve (14) to the lower packer (12) via a hydraulic pressure tube (27). The hydraulic pressure tube (27) is made of a rigid durable material, such as a hard polymeric material.

The electrolyte containment sleeve (14) is located above the lower packer (12). The sleeve (14) is also made of a flexible, durable material, such as rubber or plastic or a polymeric material, such as polyvinyl chloride. For use in a horizontal drilled borehole, the sleeve (14) is filled prior to lowering the apparatus down the drilled borehole (11) with an aqueous electrolyte which is appropriate for generating the desired combination of gases to be ignited in the drilled borehole and sealed so that the electrolyte cannot flow out of the sleeve until the structural integrity of the sleeve is broken. The sleeve (14) also contains at least one elongated electrolysis cell (16) but a plurality of elongated electrolysis cells (16) is preferred for use in deep drilled boreholes. The electrolysis cells (16) are located in an alternating sequence between the ignition means or igniters (18). The fewer number of electrolysis cells which are present in the sleeve (14), the longer it will take to generate the gas required to fracture the drilled borehole (11).

Each of the electrolysis cells (16) is composed of a plurality of cascaded metal electrodes (32). The electrolysis cells (16) contained in the sleeve (14) are distributed along the longitudinal borehole axis to provide the desired large surface area of electrode-to-electrolyte contact necessary for producing the gas mixture at the highest practical rate compatible with the elongated borehole geometry. Cascaded-electrode electrolysis allows the cells to operate in electrical series and, hence, to be energized from a higher voltage source than that required for a single electrolysis cell. The plurality of electrolysis cells (16) composed of the cascaded metal electrodes (32) are connected in parallel to achieve maximum operating efficiency in the remote cable-powered gas-generating system.

Figure 4A:
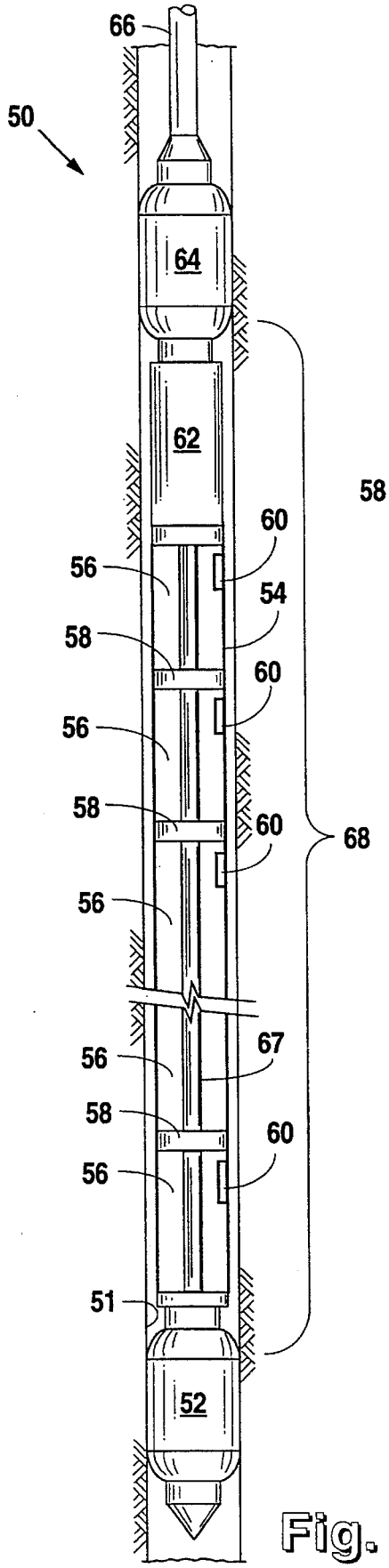
FIG. 4A illustrates a cross-sectional view of the apparatus of the present invention for use in a deep drilled vertical borehole.
Figure 4B:
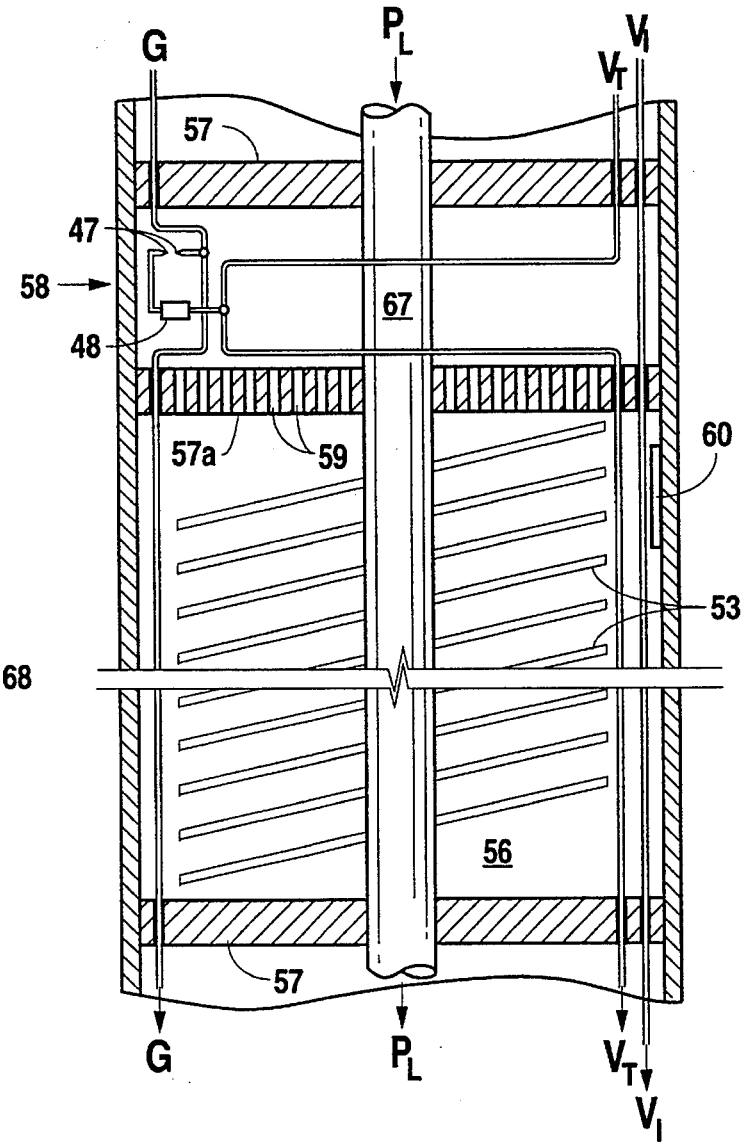
FIG. 4B illustrates a cross-sectional view of an electrolysis cell and igniter in an apparatus of the present invention for use in a deep drilled vertical borehole.
Figure 6A:
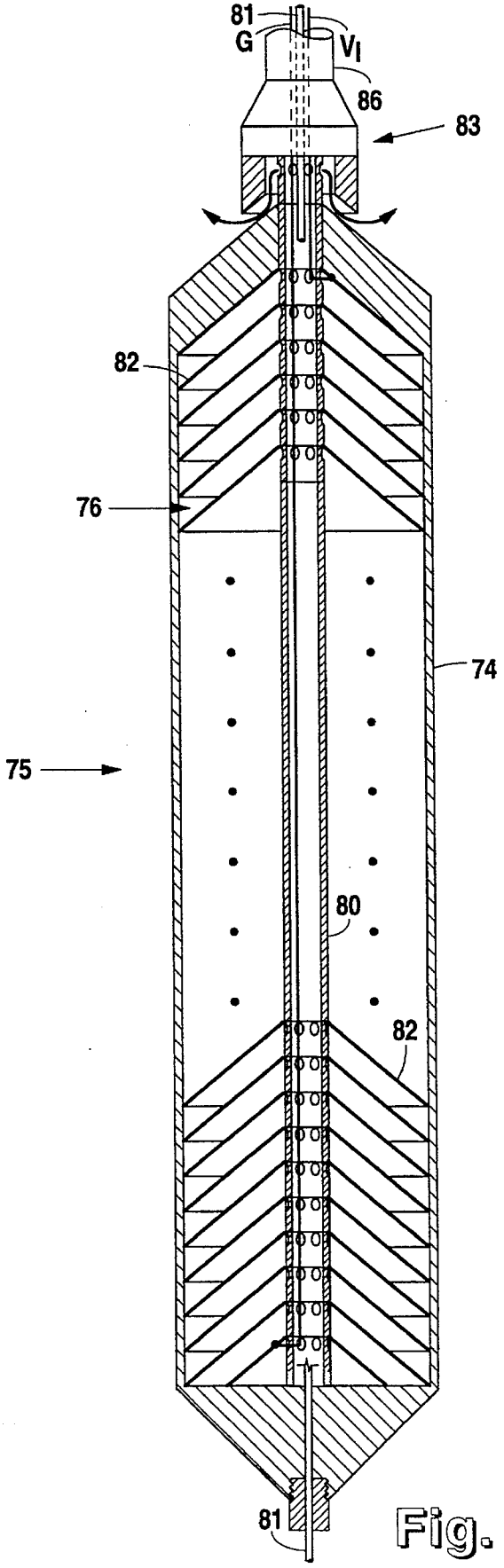
FIG. 6A illustrates a cross-sectional view of an electrolyzer of the present invention for use in a shallow or deep drilled vertical borehole.

Electrolysis cell designs are adaptable for use in either horizontal or vertical drilled boreholes. The cascaded metal electrodes are configured so as to achieve maximum electrolysis and production of gases in either a horizontal or vertical drilled borehole. In either type of drilled borehole the cascaded metal electrodes are parallel to each other. In the horizontal drilled borehole, the cascaded metal electrodes (32) are preferably perpendicular to the longitudinal axis of the drilled borehole as shown in FIG. 2. In an alternative configuration, the cascaded metal electrodes may be slanted to the longitudinal axis of drilled borehole. In a vertical drilled borehole, the cascaded metal electrodes may be slanted to the longitudinal axis of the drilled borehole as shown in FIG. 4B, but are preferably conical-shaped as shown in FIG. 6A.

There is at least one ignition means (18) but a plurality of ignition means (18) which are distributed in an alternating sequence with the electrolysis cells (16) is preferred. Electric arc igniters are the preferred ignition means and are well known in the art. The preferred electric arc igniters have bulkheads or walls running perpendicular to the longitudinal axis of the drilled borehole. (See (45) in FIG. 3). These bulkheads (45) contain a plurality of uniformly spaced, drilled holes or perforations (49) which allow the electrolyte and generated gases to flow between electrolysis cells (16).

The electric arc igniters are used to initiate the gaseous explosion at several positions simultaneously along the borehole fracturing zone (28). This arrangement will ensure that any isolated pockets of explosive gas mixture will be ignited and, importantly, the explosive pressure will be applied to the borehole wall with minimum time delay compared with the delay time associated with combustion flame front propagation along the paths between widely spaced igniters. In horizontal drilled boreholes, it is advantageous to use a pendulum-mounted electric arc igniter as shown in detail in FIG. 3 because the generated gas will accumulate along the top side of the drilled borehole. Thus, the electric arc ignition cavity (46) containing the arc electrodes (47) of the pendulum-mounted electric arc igniter will always be located along the top side of the drilled borehole.

The electrolyte containment sleeve (14) also contains a gas releasing means and in the case of FIG. 1, this means is at least one disrupter (20) for breaking the structural integrity of the sleeve by making small gas-releasing perforations in the sleeve (14). The disrupter (20) is affixed to the surface of the sleeve (14) and preferably on the surface of the sleeve (14) directly adjacent to each electrolysis cell (16). The sleeve (14) is the closed container which holds the aqueous electrolyte and carries it from the surface of the ground to the desired zone in the drilled borehole where the gas is to be generated. After the apparatus has been delivered down the drilled borehole to the desired zone (28) to be subjected to gaseous fracture and the lower packer and upper packer have been inflated, and the electrical current run for a sufficient time to accumulate a preliminary amount of gas in the sleeve (14) then the structural integrity of the sleeve (14) must be broken so that gas generated by .continuing the electrolysis process can expand further and fill the zone of the borehole and the pre-existing fractures in deep drilled borehole walls. The disrupter (20) can be any apparatus that will cause a break in the structural integrity of the surface of the sleeve but a heating element is preferred. It is preferable that the disrupter (20) be located at a position near the top side of the borehole, but because the apparatus is lowered in the drilled borehole, the location of the disrupter (20) in relation to its orientation in the borehole cannot be guaranteed. Regardless of its position on the downhole delivered apparatus, the disrupter (20) functions to allow the release of generated gas. These disrupters (20) are activated by an electrical current from above the ground through the multipurpose cable (26) through the control module (22).

The control module.(22) of the elongated gas generating apparatus (10) of FIG. 1 is shown in detail in FIG. 2. The control module (22) contains an electrical power conditioner and command decoder (34) which receives the electrical power delivered from the surface of the ground through the multipurpose cable (26). The functions of the electrical power conditioner and command decoder are to regulate the voltage and/or current applied to the electrolysis cells and to translate surface commands sent downhole, to operate the packers, to activate the containment sleeve disrupters (20), and to trigger the igniters (18). The control module (22) also contains an upper packer hydraulic valve (36) and a lower packer hydraulic valve (38) which are used to control the inflation and deflation of the upper and lower packers, respectively, at the appropriate times when using the apparatus. The control module (22) also contains an igniter high voltage power supply and trigger circuit (40) which converts the power supplied to the control module (22) to high voltage power by transformer step-up and rectification. This high voltage power activates the trigger circuit or switch activating the arc electrodes (47) causing a spark which is used to ignite the combustible gas generated by the apparatus (10) when sufficient gas has been generated.

Figure 3:
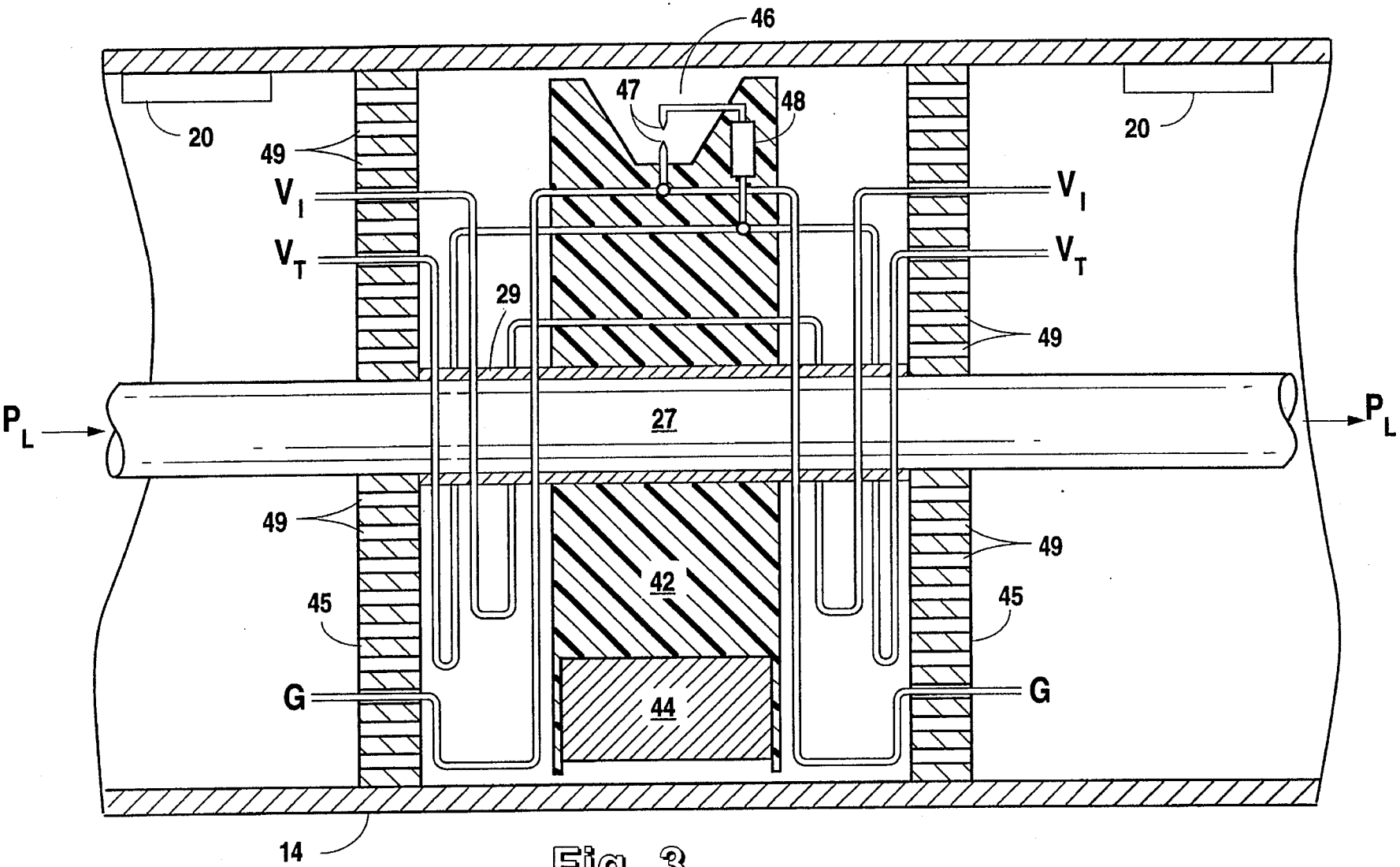
FIG. 3 illustrates a cross-sectional view of the pendulum-mounted electric arc igniter for use in the apparatus in a deep drilled horizontal borehole.

The wires in FIGS. 2 and 3 are designated $V_1$ for the electrolysis voltage, $V_T$ for the igniter voltage, and G for the ground wire. The hydraulic pressure to the lower packer from the control module (22) is designated $P_L$.

All of the components of the gas generating apparatus (10) are connected to an electrical power supply and to a supply for inflating the packers, such as a hydraulic supply, through a multipurpose suspension cable (26). The cable (26) functions as the conduit to bring primary electrical power down the drilled borehole to the control module (22), to operate the electrolysis process, and to bring hydraulic fluid or oil to the upper and lower packers. After the cable (26) reaches the control module (22), only the hydraulic cable or rigid pipe (27) continues through the containment sleeve (14) to the lower packer (12) by passing through the cascaded metal electrodes (32) and igniter means (18). The cable (26) also functions as a means to connect the components of the apparatus (10) for the operation of the apparatus in the drilled borehole.

FIG. 3 illustrates a specific type of electric arc igniter that is used in deep horizontal drilled boreholes. This type of electric arc igniter is a pendulum-mounted electric arc igniter (18) which contains a rotary disk pendulum (42) containing a pendulum weight (44), two bulkheads (45) with gas vent holes (49), an electric arc ignition cavity (46) , arc electrodes (47) , and an arc isolation resistor (48). The rotary disk pendulum (42) is mounted on a freely rotating sleeve (29) and rotates around the hydraulic cable (27) component extending from the multipurpose suspension cable (26). The rotary disk can be made of any material as long as the area around the arc electrodes (47) is insulated. Preferably, the rotary disk pendulum is made of a solid, circular piece of plastic. The electric arc ignition cavity (46) is a cutout portion of this piece of plastic which exposes the arc electrodes (47). In a horizontal drilled borehole, the pendulum weight (44) will be oriented toward the bottom side of the drilled borehole which results in the electric arc ignition cavity (46), the arc electrodes (47) and the arc isolation resistor (48) being oriented adjacent to the top side of the horizontal drilled borehole. The wires $G_1$, $V_T$, and $V_1$ have sufficient slack in their length so that they can wrap around (27) if necessary when the igniter (18) orients itself when it reaches the horizontal portion of the drilled borehole as shown in FIG. 3. This orientation is important because the generated gas accumulates along the top side of the horizontal drilled borehole. The pendulum-mounted electric arc igniter (18) operates by gravity to orient the arc electrodes (47) toward the top side of the borehole. An arc discharge is produced when the high voltage ignition pulse is applied to the igniter wiring. The arc isolation resistor (48) serves to isolate the arc electrodes (47) in case they should become fouled by borehole debris so that the other igniters will remain operational.

The apparatus (10) described in FIGS. 1–3 can also be used in deep vertical drilled boreholes with a few variations in the configuration of some of the components. FIG. 4A illustrates the apparatus (50) for deep vertical drilled boreholes. The apparatus comprises a lower packer (52) which is attached to a first end of the apparatus; an upper packer (64) attached to a second end of the apparatus; an electrolyte containment sleeve (54) extending intermediate the first end and the second end; at least one elongated electrolysis cell (56) disposed within the sleeve which is capable of producing a stoichiometric mixture of combustible gases by electrolysis of an aqueous electrolyte retained within the sleeve; at least one ignition means (58) for igniting the mixture of gases; a gas releasing means consisting of at least one disrupter (60) affixed to or present within the sleeve (54) for allowing the combustible gases to be discharged from the sleeve (54) into the drilled borehole (51); and a multipurpose suspension cable (66) attached to the second end of the apparatus for supplying electrical power for electrolysis, for energizing the ignition means (58), and for the operation of and for the supply of hydraulic fluid to the upper (64) and lower (52) packers. A control module (62) containing electrical and hydraulic control means, an igniter power supply, and an igniter trigger circuit which are identical to those in the control module (22) is located between the upper packer (64) and the electrolyte containment sleeve (54). After the cable (66) reaches the control module (62), only the hydraulic cable or rigid pipe (67) continues through the containment sleeve (54) to the lower packer (52) by passing through the cascade metal electrodes (53) and igniter means (58).

The differences between apparatus (10) and apparatus (50) are that the cascaded metal electrodes (32) of the electrolysis cells (16) of apparatus (10) are perpendicular or slanted to the longitudinal axis of the drilled borehole (11) whereas the cascaded metal electrodes (53) of the electrolysis cells (56) of apparatus (50) are either slanted as illustrated in FIG. 4B or conical-shaped metal electrodes (82) as illustrated in FIG. 6A for a shallow vertical drilled borehole. Additionally, the ignition means (58) is a simple electric arc igniter and does not require a rotary disk pendulum as shown in FIG. 3. The orientation of the igniter is not critical in a vertical drilled borehole. The upper bulkheads (57) of the igniters (58) function as partitions to separate each of the electrolysis cells (56) along with their electrolyte and generated gases. The gases initially accumulate near the top of the partitioned sleeve (54) of the apparatus and eventually throughout the section of the drilled vertical borehole located between the first and second ends of the apparatus after the disrupters (60) are activated. A disrupter (60) is present in the sleeve adjacent to each electrolysis cell (56) and is preferably located near the top of each of the partitions separating the electrolysis cells (56), which allows the escape of generated gases yet maintains the electrolyte inside the sleeve (54). Another difference between the ignition means (18) and (58) is that the bottom bulkhead (57a) of igniter (58) as oriented in the borehole contains one or more gas vent holes (59) or perforations, whereas in igniter (18), both bulk heads (45) contain one or more gas vent holes (49). These holes or perforations allow the generated gases to enter the igniter for ignition in both configurations.

The method of gaseously exploding a zone (28) or (68) of a drilled borehole is the same for both a deep horizontal and a deep vertical drilled borehole. The method comprises the following steps: lowering the elongated gas generating apparatus (10) or (50) into a zone (28) or (68) of a drilled borehole, where the electrolyte containment sleeve (14) or (54) contains an aqueous electrolyte; inflating the lower packer (12) or (52) and upper packer (24) or (64) via a connection to the hydraulic supply through the multipurpose suspension cable (26) or (66) with hydraulic fluid or oil; first running an electrical current to the electrolysis cell (16) or (56) via the-multipurpose suspension cable (26) or (66) to produce a preliminary amount of stoichiometric mixture of combustible gases in the sleeve (14) or (54); initiating activation of the disrupters (20) or (60), which are the gas releasing means, to break the structural integrity of the electrolyte containment sleeve (14) or (54) via a connection to the electrical power supply through the multipurpose suspension cable (26) or (66); continuing to run the electrical current to the electrolysis cells (16) or (56) for a period of time to accumulate a sufficient amount of stoichiometric mixture of combustible gases to fracture the zone of the drilled borehole; and igniting the mixture of combustible gases using the ignition means (18) or (58) activated by the igniter power supply and trigger circuit illustrated by (40) of FIG. 2 to cause a combustion pressure impulse in the zone (28) or (68) of the drilled borehole.

The electrolyte containment sleeve (14) or (54) contains a plurality of elongated electrolysis cells (16) or (56) and a plurality of ignition means (18) or (58) in an alternating sequence. The electrolysis cells (16) or (56) are composed of a plurality of cascaded metal electrodes (32) or (53), respectively. The cascaded metal electrodes (32) of FIG. 2 are parallel to each other. In a horizontal drilled borehole, the cascaded metal electrodes (32) are planar elements perpendicular or slanted with respect to the longitudinal axis of the drilled borehole. In a vertical drilled borehole, the cascaded metal electrodes are planar elements slanted with respect to the longitudinal axis of the drilled borehole as shown in FIG. 4B (53) or conical-shaped as shown in FIG. 6A (82).

The gases generated by the apparatus can be a stoichiometric mixture of any combustible gases capable of being generated by electrolysis, but a stoichiometric mixture of oxygen and hydrogen is preferred.

The preferred gas releasing means for the apparatus shown in FIGS. 1 and 4A is at least one disrupter (20) or (60), which preferably is a heating element affixed to the surface of the electrolyte containment sleeve (14) or (54). These disrupters (20) or (60) are activated by an electrical current from above ground through the multipurpose cable (26) or (66) through the control module.

In a vertical drilled borehole, a fixed electric arc igniter (58) as shown in FIG. 4B may be utilized whereas in a horizontal drilled borehole, a pendulum mounted arc igniter (18) as shown in FIG. 3 is required to be utilized.

The electrical current is run for a period of time to accumulate a sufficient stoichiometric mixture of combustible gases to explosively fracture the selected zone of the drilled borehole. The electrical current may have to be run for a few minutes or may be run for many hours depending upon the depth below the surface of the borehole zone to be fractured and the composition of the formation to be fractured. Eight to ten hours is preferred and generally long enough to provide sufficient gas for the explosion in most formations. When the gas mixture is exploded, the entire apparatus (10) or (50) is disabled or destroyed. If a further explosion is desired, a new apparatus must be used. For deep drilled boreholes, the oxygen and hydrogen generated by the electrolyzer in 8–10 hours will uniformly fill the section of the borehole which the user wishes to fracture. The apparatus may extend for up to a 1000 feet along the borehole. The oxygen and hydrogen will stay in the proximity of the apparatus as a result of the lower and upper packers.

Because the mixture of gases are distributed along the borehole, the explosive impulse is also distributed along the borehole. The explosive impulse has a shock wave effect and this shock wave may be strong enough to break the rock at distances up to 50 diameters of the drilled borehole if the energy is sufficiently high and the shock wave rise time is properly matched to the fracture characteristics of the rock.

The following analysis of the electrolysis process presents the electrochemical and thermodynamic considerations necessary for determining the theoretical feasibility of the downhole oxygen and hydrogen gas generating process. This analysis also estimates the time required to generate a substantial explosive fracture gas charge for the apparatus of FIGS. 1 and 4A. The overall conversion efficiency from electrical input energy to explosive chemical reaction energy is also estimated for-this preliminary example.

Electrolysis of water will produce a stoichiometric mixture of oxygen and hydrogen which may be ignited to release the latent chemical energy of the hydrogen fuel in a high-temperature pressure impulse. The following analysis, applied to an electrolyte solution of sodium hydroxide as one example, develops estimates of the gas mixture evolution rate, the latent chemical energy accumulation rate, and the gas mixture pressure build up rate in a confined volume as driven by the electrical current flowing through the gas generating apparatus. This analysis is applied, first, to a single electrolysis cell and is then extended to multiple-electrolysis cell cascade operation (multiple electrolysis cells containing cascaded metal electrodes arranged in electrical series) for efficient gas production in applications using remote current-carrying cables of the present invention. A preliminary design of a multi-cell electrolysis system is presented to characterize the application of this concept to oil and gas well explosive impulse fracture stimulation.

For the electrolyte sodium hydroxide (NaOH), the anode reaction under proper applied voltage and current for decomposition of water is:

$$4OH^- = 4e^- + 2H_2O + O_2\uparrow$$

indicating that four electrons having an elemental electric charge of $1.602\times10^{-19}$ Coulomb/electron will liberate one molecule of oxygen ($O_2$) gas. Applying Avogadro's number, $N_A$, the oxygen mass evolution per Coulomb of electric charge is:

$$M(O_2) = \frac{m(O_2)}{4N_A q_e} = \frac{2(16)}{4(6.025\times10^{23})(1.602\times10^{-19})(1{,}000)}$$

$$= 8.288\times10^{-8}\,\frac{\text{kg}}{\text{C}}\ O_2\uparrow.$$

The corresponding cathode reaction is:

$$2H^+ = H_2\uparrow - 2e^-$$

indicating that two electrons will liberate one molecule of hydrogen ($H_2$) gas, resulting in a hydrogen mass evolution rate $$M(H_2) = \frac{m(H_2)}{2N_A q_e} = \frac{2(1.008)}{2(6.025\times10^{23})(1.602\times10^{-19})(1{,}000)}$$

-continued $$= 1.044\times10^{-8}\,\frac{\text{kg}}{\text{C}}\ H_2\uparrow.$$

Thus, in terms of the electrolysis cell current, the oxygen and hydrogen mass evolution rates are:

$$M(O_2) = 8.288\times10^{-8}\,\frac{\text{kg}}{\text{sec}}\ \text{per ampere}$$

$$M(H_2) = 1.044\times10^{-8}\,\frac{\text{kg}}{\text{sec}}\ \text{per ampere.}$$

For a stoichiometric mixture of oxygen and hydrogen at one atmosphere, the partial pressures of the gas constituents are:

$$p(O_2)+p(H_2)=,300\ \text{Pa}$$

$$p(O_2)=\tfrac{1}{2}p\ (H_2)\ \text{(stoichiometric)}$$

from which $$p(O_2) = \frac{101{,}300}{3} = 33{,}767\ \text{Pa}$$

and $$p(H_2) = 101{,}300 - 33{,}767 = 67{,}533\ \text{Pa.}$$

Assuming the gas mixture to be an ideal gas, then, by the molar gas law, $$p\ v\ m = M\ R\ T$$

where:

$p$ = gas pressure;

$v$ = gas volume;

$m$ = molecular weight of gas;

$M$ = mass of gas;

$T$ = absolute temperature of gas;

$R$ = universal molar gas constant, $$8.317\times10^{3}\,\frac{J}{\text{kg}-\text{mol}\cdot{}^\circ\text{K.}}$$

Equation (8) may be expressed in time-dependent form as $$\frac{dv}{dt} = \left(\frac{RT}{pm}\right)\frac{dM}{dt}$$

to represent the volumetric gas evolution rate of either constituent of the gas mixture. The rate of volume increase versus time will be the same for each constituent of the gas mixture and, hence, using the values for oxygen $$m(O_2) = 2(16) = 32$$

$$\frac{dM(O_2)}{dt} = M(O_2) = 8.288\times10^{-8}\,\frac{\text{kg}}{A\cdot\text{sec}}$$

$$p(O_2) = 33{,}767\ \text{Pa,}$$

the gas mixture evolution rate at reference conditions of one atmosphere and 273.1° K. temperature is $$\frac{dv}{dt} = \frac{8.317 \times 10^3(273.1)(8.288 \times 10^{-8})}{33{,}676(32)}$$

$$= 1.742 \times 10^{-7} \frac{m^3}{A \cdot \text{sec}}$$

$$= 1.742 \times 10^{-4} \frac{l}{A \cdot \text{sec}} \text{ at 1 atm and 273.1° K.}$$

The heat of combustion reaction (lower heating value) of hydrogen is $$Q_{H_2} = 119{,}954 \frac{\text{kJ}}{\text{kg}} .$$

Based upon the mass evolution rate of hydrogen stated in Equation (5), the latent chemical energy developed per Coulomb of electrolysis and releasable on combustion of the resulting stoichiometric oxygen-hydrogen mixture is $$E_{H_2}|_{mass} = Q_{H_2} \frac{dM(H_2)}{dt}$$

$$= Q_{H_2} M(H_2)$$

$$= 119{,}954(1.044 \times 10^{-8})$$

$$= 1.252 \frac{J}{A \cdot \text{sec}} .$$

Expressed in terms of the volume of the gas mixture produced per Coulomb of electrolysis, the energy releasable on combustion is $$E_{H_2}|_{vol} = \frac{E_{H_2}|_{mass}}{\left(\frac{dv}{dt}\right)}$$

$$= \frac{1.252}{1.742 \times 10^{-4}} = 7{,}187 \frac{J}{l} \text{ at 1 atm and 273.1° K.}$$

Upon combustion, the stoichiometric mixture of oxygen and hydrogen will react to form water vapor at a peak temperature of about 2,500–3,000° K. [NOTE: The stoichiometric oxygen-hydrogen gas mixture discussed above has the highest practical energy of combustion reaction available. The next highest energy of combustion reaction is that of a gas mixture of oxygen and methane ($CH_4$) which, in a stoichiometric reaction, will have a heat energy of combustion of $$Q_{CH_4} = 50{,}010 \frac{\text{kJ}}{\text{kg}} \text{ (41.7\% of the value for } O_2 - H_2)$$

and will yield combustion products of carbon dioxide gas and free carbon soot.]

The pressure buildup versus time resulting from the electrolytic decomposition of water may be derived for the case of constant volume constraint. For an electrolysis cell current, I, the volumetric evolution rate of the oxygen-hydrogen gas mixture at reference conditions of one atmosphere pressure and 273.1° K. temperature is $$\frac{dv}{dt} = 1.742 \times 10^{-4} I \frac{l}{\text{sec}}$$

and the gas volume at any time, to, for constant current in the cell is $$V_g(t) = 1.742 \times 10^{-4} I \int_o^{t_c} dt$$

$$= 1.742 \times 10^{-4} I t_c \, l.$$

For constant volume containment of the evolving gas, neglecting any increase in temperature of the gas during its relatively slow buildup, the gas pressure at any time, $t_c$, for one electrolysis cell is $$P_c(t) = \frac{P_{ref} V_g(t)}{V_c}$$

$$= 101{,}300(1.742 \times 10^{-4}) \frac{It_c}{V_c}$$

$$= 17.646 \frac{It_c}{V_c} \text{ Pa}$$

where:

$P_c$=pressure in confined volume;

$V_c$=confined volume (l);

$t_c$=time duration of electrolyzer cell current flow.

$$V_c = \frac{\pi D^2}{4} L; \text{ in which } \quad D = 0.1524 \text{ m(6 in.)}, \; L = 304.8 \text{ m(1,000 ft)}$$

$$V_c = 5.560 \text{ m}^3(5{,}560 \; l)$$

$$I = 10 \; A,$$

$$P_c(t) = \frac{17.646(10)}{5{,}560} t_c$$

$$= 3.174 \times 10^{-2} t_c \text{ Pa}$$

$$= 3.133 \times 10^{-7} t_c \text{ atm.}$$

Thus, within an electrolysis cell operating time of $t_c$=1 hour, the over-pressure of the stoichiometric oxygen-hydrogen gas mixture in volume $V_c$ will be, for one cell $P_c$(,600)=.26Pa (,128×10$^{-3}$atm) .658×10$^{-2}$psig).

For this constant volume example, the rate of pressure increase is linear with respect to time and, hence, for, say, 750 cells, may be expressed in various alternative units as $$\frac{dP_c}{dt} = 3.174 \times 10^{-2}(750) = 23.81 \frac{\text{Pa}}{\text{sec}}$$

$$= 114.26(750) = 85{,}695 \frac{\text{Pa}}{\text{hr}}$$

$$= \frac{85{,}695}{101{,}300} = 0.846 \frac{\text{atm}}{\text{hr}}$$

$$= 0.846(14.7) = 12.44 \frac{\text{psig}}{\text{hr}} .$$

The design parameters of the multiple-electrolysis cell apparatus of FIGS. 1 and 4A are as follows:

| Preliminary Design of a Multi-Cell Cascade Apparatus | |
|---|---|
| Multi-Cell Cascade Apparatus: | 750 cells |
| Total Number of 750-Cell (33.33-ft) Units in 1,000 ft.: | 30 Units |
| Total Electrical Power in 30 Units: | 283.5 kW |
| Pressure Buildup Rate for 30 Units: | 12.44(30) = 373.2 psig/hr |
| Time Required to Reach a Pressure of 3,500 psig: | 9.38 hrs. |
| Latenet Chemical Energy, $E_{H_2}$, at 3,500 psig in 1,000 ft: | $7{,}187(5{,}560)\left(\frac{3{,}500}{14.7}\right) = 9.514\times10^9$ J. |
| Combustion Impulse Pressure at 2,750° K. peak flame temperature and 80° C. Formation Temperature: | $3{,}500\left(\frac{2{,}750}{273.1+80}\right) = 27{,}270$ psi pk |

Pressure-Retaining Packers: Use one at each end of the 1,000 ft. (30 Unit) electrolyzer string to retain evolved gas pressure.

Ignition of Gas Mixture: Use several (redundant) spark ignition modules placed along the 1,000 ft. electrolyzer string.

Monitor Requirements: Observe and record surface input electrical current and voltage, gas mixture pressure buildup retained by packers, combustion impulse pressure.

The theoretical chemical-to-electrical energy conversion efficiency for the idealized conditions carried through this numerical example analysis is $$Eff = \frac{E_{H_2}}{E_{elect}} = \frac{9.514\times10^9\ J.}{945(300)(9.38)(3600)w-sec}\times100$$

$$= 99.38\%.$$

This result neglects the power dissipated in the practical liquid electrolyte current conduction path between the electrode plates and the significant fact that current can flow around the cascade of electrodes without contributing to the electrolysis process. A simplified estimate of the practical energy conversion efficiency can be made on the basis that the bypass current is equal to the electrolysis current and the cell voltage drop is approximately three times that required for electrolysis (i.e., 3×1.3v=3.9v). Thus the resistances in the electrolysis current path ($R_e$) and in the bypass current path ($R_b$) are $$R_e = \frac{3V_e - V_e}{I}$$

$$= \frac{3(1.3)-1.3}{10} = 0.26 \text{ ohm}$$

$$R_b = \frac{3V_e}{I} = \frac{3(1.3)}{10} = 0.39 \text{ ohm.}$$

Thus, for an electrolysis current of 10A, the non-productive power dissipated in the electrolyte is $$P_l = I^2R_e + I^2R_b$$

-continued $$= 10^2(0.26) + 10^2(0.39)$$

$$= 26 + 39 = 65 \text{ watts/cell}$$

Therefore, the approximate electrochemical energy conversion efficiency, based upon single electrolysis cell conditions, is $$Eff = \frac{\frac{9.514\times10^9}{30(750)}}{[1.3(10)+65](9.38)(3600)}\times100$$

$$= 16.05 \text{ percent.}$$

As a projection of the typical range of improvement in this efficiency, if no bypass current existed, the electrolyte losses would be reduced from 65 watts to 26 watts and the resulting efficiency would be $$Eff|_{I_b=0} = \frac{(13+65)}{13+26}(16.05) = 32.1 \text{ percent.}$$

Figure 5:
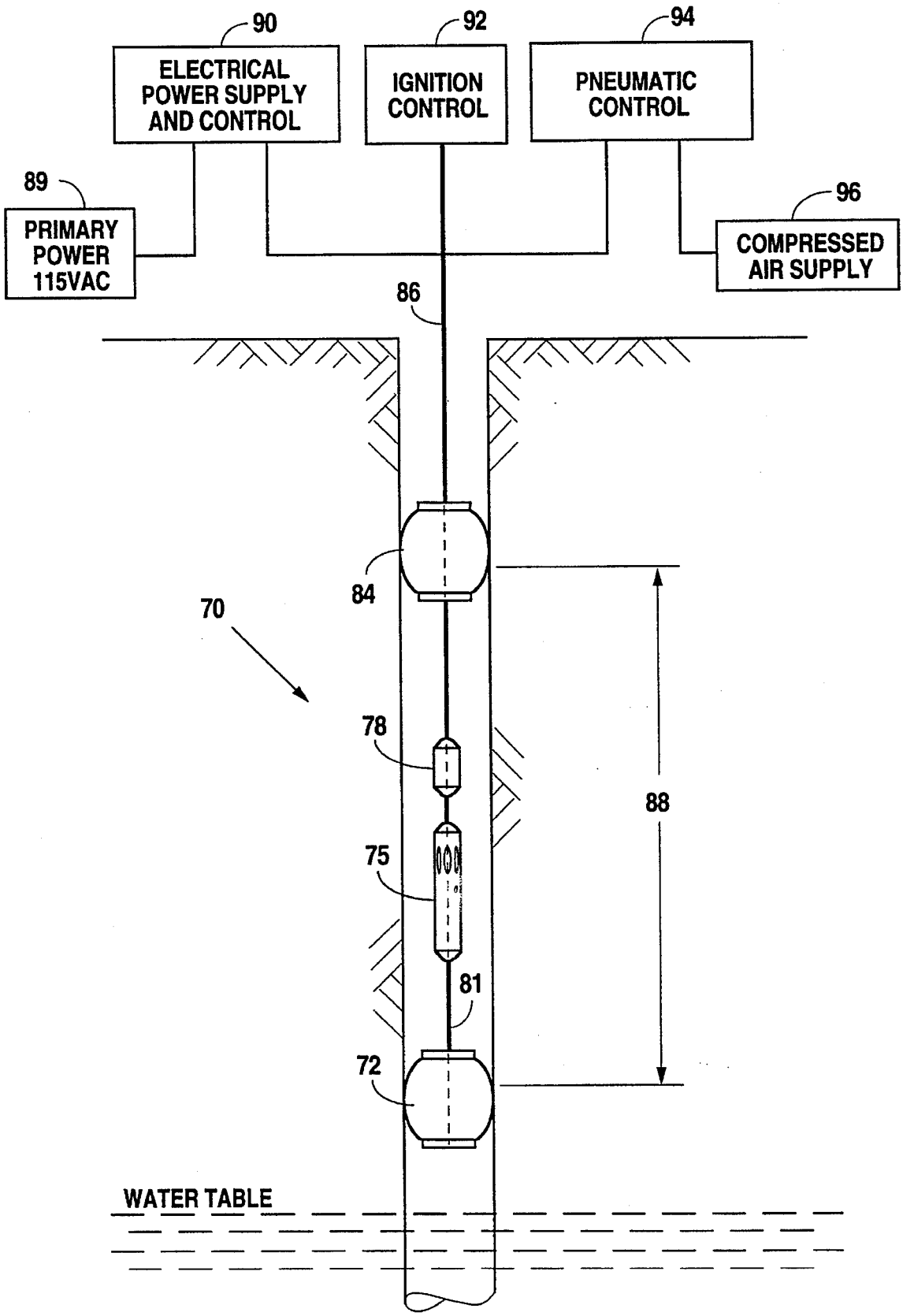
FIG. 5 illustrates a diagrammatic view of the gas generating apparatus of the present invention for use in a shallow drilled vertical borehole.

In another aspect of the present invention, an elongated gas generating apparatus for use in a shallow drilled borehole above the water table is used to increase the permeability of the soil in the area surrounding a selected zone to be loosened. FIGS. 5 and 6A illustrate the preferred apparatus.

FIG. 5 illustrates an elongated gas generating apparatus (70) for use in a zone (88) of a shallow vertical drilled borehole and FIG. 6A illustrates the electrolyzer (75) composed of the electrolyte containment sleeve (74) containing a cascaded-electrode electrolysis cell (76). The apparatus (70) of FIG. 5 comprises: a lower packer (72) attached to a first end of an apparatus; an upper packer (84) attached to a second end of an apparatus; an electrolyzer (75) composed of an electrolyte containment sleeve (74) extending intermediate the first end and the second end of the apparatus and at least one elongated electrolysis cell (76) disposed within the sleeve (74) capable of producing a stoichiometric mixture of combustible gases by electrolysis of an aqueous electrolyte retained within the sleeve (74), a gas releasing means which is a centrally located perforated gas collection tube (80) extending longitudinally through the entire length of the electrolyte containment sleeve (74) and extending out of the end of said sleeve adjacent to the second end of the apparatus; a gas outlet cap (83) located at the end of the electrolyte containment sleeve (74) adjacent to the upper packer (84); at least one ignition means (78) for igniting the mixture of gases; and a multipurpose suspension cable (86) attached to the second end of the apparatus for supplying electrical power and control (90) for electrolysis from the primary power (89), for ignition control (92) and for operation of the packers through pneumatic control (94) and for supplying compressed air from a compressed air supply (96) from the surface of the ground.

The lower (72) and upper (84) packers are standard packers used for temporarily blocking gas or liquid flow in drilled boreholes. They are made of a flexible, durable material, such as rubber or plastic or a polymeric material which can be deflated and inflated. The packers are deflated when the apparatus is placed in the drilled borehole and, when located at the desire depths in the borehole, are inflated with compressed air from the surface through the multipurpose suspension cable (86). The compressed air line (81) of the multipurpose suspension cable (86) runs through the middle of the gas collection tube (80) to the lower packer (72) (see FIG. 6A). As an alternative to apparatus (70) to be used in shallow drilled boreholes, an apparatus may only have an upper packer (84) and the bottom of the drilled borehole can function as the lower packer (72) and in that apparatus, the compressed air line would end at the gas outlet cap (83).

The electrolyzer (75) is composed of the electrolyte containment sleeve (74) which is located above the lower packer (72) . The sleeve (74) is also made of a nonconducting, flexible, durable material, such as rubber or plastic or a polymeric material, such as polyvinyl chloride. The sleeve (74) is filled with an aqueous electrolyte prior to lowering the apparatus down the drilled borehole. The aqueous electrolyte is selected based upon the desired combination of gases to be generated in the drilled borehole. The sleeve (74) contains at least one cascaded-electrode electrolysis cell (76) and, in the preferred embodiment, there is only one electrolysis cell (76) in the electrolyte containment sleeve (74). This electrolysis cell (76) is from approximately 1 to 2 feet long and slightly smaller in diameter than the electrolysis cells (16) and (56) disposed within sleeves (14) and (54) of FIGS. 1 and 4A used in the deep drilled boreholes. At the upper end of the sleeve (74) housing the electrolysis cell (76) is positioned a gas outlet cap (83) through which the multipurpose suspension cable (86) runs and which allows the gases generated from the electrolysis process to escape from the apparatus into the drilled borehole through the end of the perforated gas collection tube (80) which extends out of the end of the sleeve adjacent to the second end of the apparatus. The multipurpose suspension cable (86) provides strain relief for the electrical wires and compressed air line connected to the downhole components from the surface. The multipurpose suspension cable (86) can be a continuous hollow cable made of durable polymeric or metal material. Further, the cable (86) can be plastic (PVC) pipe assembled onto the apparatus in convenient joints at the time when the apparatus is being lowered into the borehole. The electrolysis cell (76) is composed of a plurality of cascaded metal electrodes (82). The cascaded metal electrodes are preferably conical-shaped and the apex of each of the conical shaped electrodes is open for the passage of the perforated gas collection tube (80). The cascaded metal electrodes (82) can also be planar elements slanted with respect to the longitudinal axis of the drilled borehole.

The gases generated by the apparatus can be a stoichiometric mixture of any combustible gases capable of being generated by the electrolysis process, but a stoichiometric mixture of oxygen and hydrogen is preferred.

The ignition means (78) is an electric arc igniter with arc electrodes (47) and an arc isolation resistor (48) as used in the ignition means (58) of FIG. 4B.

Apparatus (70) is used in a method of impulsively pressurizing by means of a combustion pulse a zone of a shallow drilled borehole to enhance the permeability of the soil surrounding the zone. The method includes the following steps: lowering the elongated gas generating apparatus (70) into a zone (88) of a drilled borehole, where the electrolyzer (75) is composed of the electrolyte containment sleeve (74) containing the electrolysis cell (76) and an aqueous electrolyte; inflating the lower packer (72) via a connection to the pneumatic control (94) and compressed air supply (96) through the multipurpose suspension cable (86); first running electrical current to the electrolysis cell (76) via the multipurpose suspension cable (86) for a period of time to purge the existing air or gases out of the drilled borehole; inflating the upper packer (84) via a connection to a pneumatic control (94) and compressed air Supply (96) through the multipurpose suspension cable (86); continuing to run the electrical current to the electrolysis cell (76) for a period of time to accumulate a sufficient stoichiometric mixture of combustible gases to fracture or to pulse or to enhance the permeability of the zone (88) of the drilled borehole when exploded; and igniting the mixture of combustible gases using the ignition means (78) activated by the ignition control (92) to cause a combustion pulse in the zone (88) of the drilled borehole.

When the apparatus alternatively does not contain a lower packer but instead uses the bottom of the drilled borehole as the packer, the inflation step of the lower packer (72) is omitted.

The mixture of combustible gases generated from the electrodes by the method collects in and rises to the end of the perforated gas collection tube (80) adjacent to the second end of the apparatus and passes out of the tube into the drilled borehole under the portion of the gas outlet cap (83) adjacent to the second end of the electrolyzer (75).

The electrical current should preferably be run for at least 5 minutes to purge the drilled borehole of preexisting gases and then after the upper packer is inflated for at least another 5 minutes to accumulate a sufficient stoichiometric mixture of combustible gases but it may be run for a longer period of time, such as 15 minutes, to accumulate more gas. The determination of the time period to be used must take into account the size and length of the borehole zone between the packers and the condition and texture of the soil as well as the level of permeability of the soil which is desired from the operation of the method without damaging the drilled borehole. The method can be repeated for a number of times sufficient to achieve the desired permeability of the soil surrounding the drilled borehole. The low energy level of the generated impulse allows the apparatus to be used repeatedly.

Figure 7:
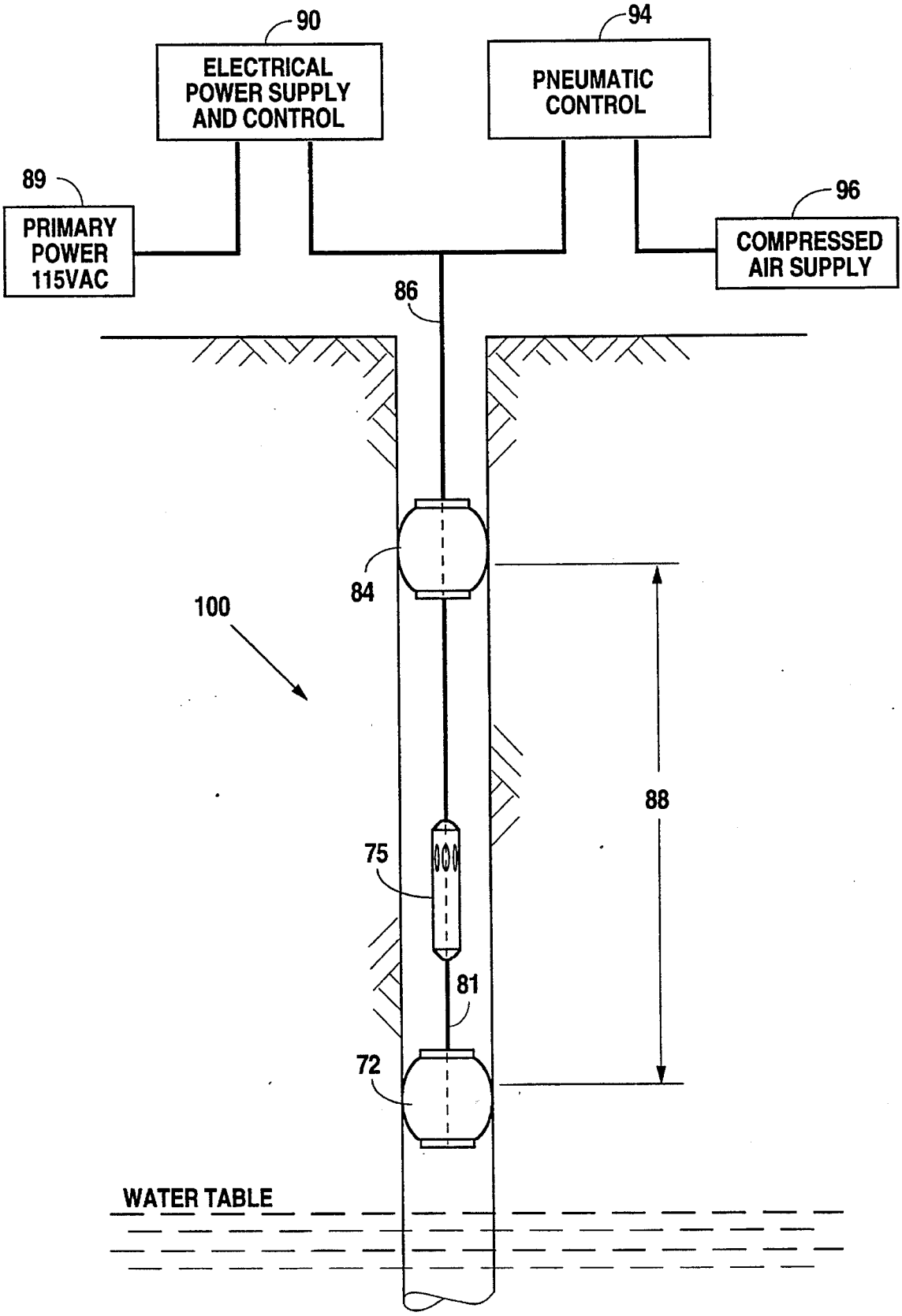
FIG. 7 illustrates a diagrammatic view of the gas generating apparatus of the present invention for use in a shallow drilled vertical borehole.

In another embodiment of the present invention, an apparatus (100) similar to apparatus (70) as shown in FIG. 5, but without an ignition means, is shown in FIG. 7. This apparatus uses the same electrolyzer (75) composed of the electrolyte containment sleeve (74) with electrolysis cell (76) of FIG. 6A. The method of using this apparatus is the same as the method for using apparatus (70) without igniting the gases generated in the drilled borehole. The apparatus (100) of FIG. 7 comprises: a lower packer (72) attached to a first end of an apparatus; an upper packer (84) attached to a second end of an apparatus; an electrolyzer (75) composed of an electrolyte containment sleeve (74) extending intermediate the first end and the second end of the apparatus and at least one elongated electrolysis cell (76) disposed within the sleeve (74) capable of producing at least one gas by electrolysis of an aqueous electrolyte retained with the sleeve; a gas releasing means which is a centrally located perforated gas collection tube (80) extending longitudinally through the entire length of the electrolyte containment sleeve (74) and extending out of the end of said sleeve adjacent to the second end of the apparatus; and a multipurpose suspension cable (86) attached to the second end of the apparatus for supplying electrical power and control (90) for electrolysis from the primary power (89), and for operation of the packers through pneumatic control (94) and compressed air supply (96) from the surface of the ground.

Figure 6B:
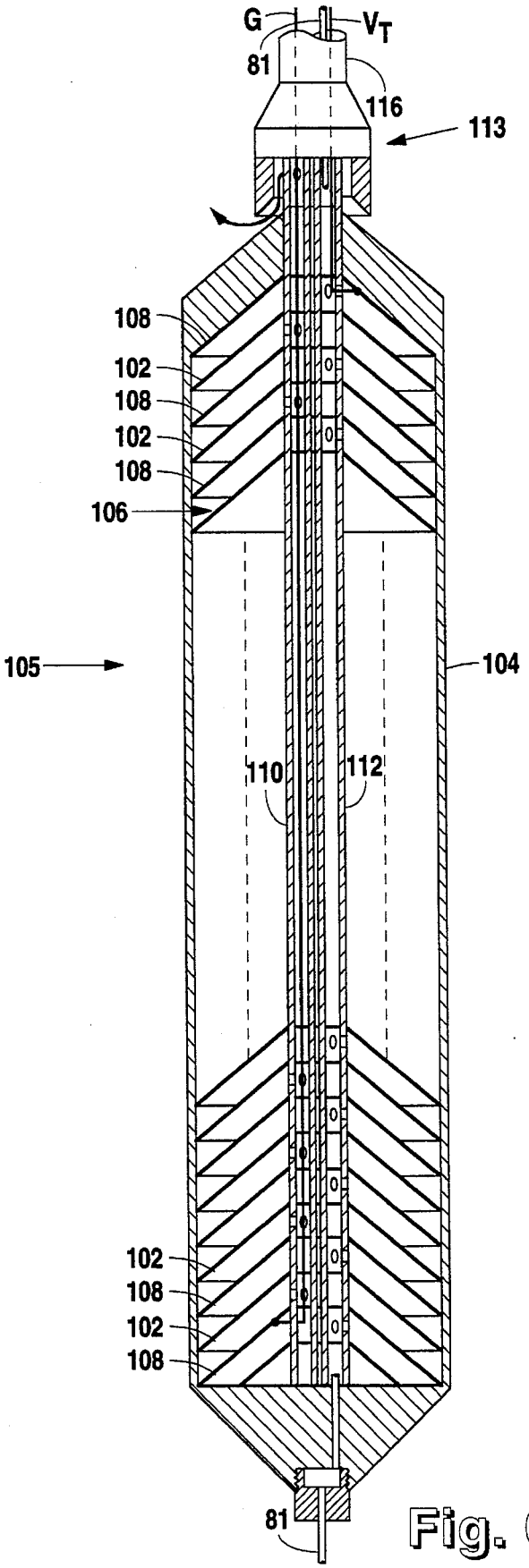
FIG. 6B illustrates a cross-sectional view of an alternative electrolyzer of the present invention for use in a shallow drilled vertical borehole.

The electrolysis cell (76) of apparatus (100) is composed of a plurality of cascaded metal electrodes (82) as depicted in FIG. 6A. If the gases produced by apparatus (100) are to be separated so that only one gas is delivered to the soil surrounding the drilled borehole, FIG. 6B depicts an alternative electrolyzer (105) composed of an electrolyte containment sleeve (104) containing an electrolysis cell (106) which can be used in place of (75) of FIG. 6A. The electrolysis cell (106) is composed of a plurality of cascaded metal electrodes (108) alternating with gas separating membranes (102). This configuration of alternating metal electrodes (108) and gas separating membranes (102) allows one gas, for example hydrogen, to be generated on one side of one metal electrode and oxygen to be generated on the other side of the same metal electrode and be trapped and separated by the adjacent gas separating membranes (102). The gas separating membranes (102) are porous plastic membranes known as ion transfer membranes and are well known to persons skilled in working with electrolysis cells. The separated gases then flow through two adjacent parallel centrally located perforated gas collection tubes (110) and (112) with for example, the hydrogen collecting in one of the tubes (112) and venting to the surface by means of the compressed air line tube (81) located in the multipurpose suspension cable (116); and the oxygen collecting in the other tube (110) and venting through the opening in the gas outlet cap (113) into the zone of the drilled borehole for delivery into the surrounding soil. This compressed air line (81) runs through one of the perforated gas collection tubes (112) and is also used to inflate the lower packer (72) (see FIG. 6B).

The method of generating one or more gases using the apparatus (100) is as follows: lowering the elongated apparatus (100) in the drilled borehole where the electrolyzer (75) is composed of the electrolyte containment sleeve (74) containing the electrolysis cell (76) and an aqueous electrolyte; inflating the lower packer (72) via a connection to the pneumatic control (94) and supply (96) through the multipurpose suspension cable (86); first running the electrical current to the electrolysis cell (76) through the multipurpose suspension cable (86) for a period of time to purge the existing air or gases out of the drilled borehole; inflating the upper packer (84) via a connection to the pneumatic control (94) and supply (96) through the multipurpose suspension cable (86); continuing to run the electrical current to the electrolysis cell (76) for a period of time to accumulate a sufficient amount of gas or gases to deliver to the soil surrounding the drilled borehole; and delivering the generated gas or gases to the soil surrounding the drilled borehole by the force of pressurization of the borehole by the gas or gases.

This alternative apparatus (100) allows the generation of a gas or gases in the shallow drilled borehole and delivery to the soil surrounding the borehole merely by the pressurization of the closed off drilled borehole or by pressurized air delivered downhole via a connection through the compressed air line (81) in the multipurpose suspension cable (86) from an air compressor or other source located on the surface.

Additionally, the apparatus (70) of the present invention could be used for one or more times to make the soil surrounding the drilled borehole permeable by igniting the combustible gases; e.g., oxygen and hydrogen; and then these gases can be generated again with apparatus (70) without ignition with the venting of hydrogen to the surface and the delivery of oxygen to the surrounding permeable soil as an oxidizing agent or a nutrient for aerobic microorganisms. Or alternatively, the apparatus (70) of the present invention can be used to generate combustible gases in the shallow drilled borehole. Once the desired permeability of the soil has been achieved, apparatus (70) can be removed from the drilled borehole. Then, the electrolyte containment sleeve (76) of apparatus (100) can be filled with another appropriate electrolyte which will generate a desired gas or combination of gases by the electrolysis process which can be used to remediate the contaminated soil surrounding the drilled borehole. As can be ascertained, any combination of the use of the apparatuses (70) and (100) to generate combustible or non-combustible gases in the shallow drilled borehole can be used in the present invention.

Although applicant has described his invention in detail with regard to the preferred embodiments, the disclosure is not intended to limit the invention, but rather, it is intended to encompass such alternatives, modifications and equivalents that may be included within the spirit and scope of the invention as herein disclosed.

I claim:

1. An elongated gas generating apparatus for use in a drilled borehole comprising:

a lower packer attached to a first end of said apparatus;

an upper packer attached to a second end of said apparatus;

an electrolyte containment sleeve extending intermediate said first end and said second end;

at least one elongated electrolysis cell disposed within said sleeve, said cell capable of producing at least one gas by electrolysis of an aqueous electrolyte retained within said sleeve;

a gas releasing means affixed to or present within said sleeve allowing said gas or gases to be discharged from said sleeve into said drilled borehole; and a multipurpose suspension cable attached to said second end of said apparatus for supplying electrical power for electrolysis and for operation of said packers and for supplying hydraulic fluid or compressed air to said packers.

2. The apparatus of claim 1, wherein said cell is capable of producing a stoichiometric mixture of combustible gases and said apparatus further comprising at least one ignition means for igniting said mixture of said gases.

3. The apparatus of claim 2, wherein said electrolyte containment sleeve contains a plurality of said elongated electrolysis cells and a plurality of said ignition means in an alternating sequence.

4. The apparatus of claim 3, wherein each of said electrolysis cells contains a plurality of cascaded metal electrodes.

5. The apparatus of claim 2, wherein said ignition means is disposed within said sleeve.

6. The apparatus of claim 2, wherein said gas releasing means is at least one disrupter affixed to the surface of said sleeve for breaking the structural integrity of said electrolyte containment sleeve.

7. The apparatus of claim 1, wherein said gas releasing means is a centrally located perforated gas collection tube extending longitudinally through the entire length of said electrolyte containment sleeve and extending out of the end of said sleeve adjacent to said second end of said apparatus.

8. The apparatus of claim 7, wherein said electrolysis cell contains a plurality of cascaded metal electrodes.

9. The apparatus of claim 1, wherein said electrolysis cell contains a plurality of cascaded metal electrodes alternating with gas separating membranes, and wherein said gas releasing means is two adjacent parallel centrally located perforated gas collection tubes allowing separated gases to flow separately through said tubes.

10. A method of generating one or more gases in a zone of a drilled borehole comprising:

lowering into said zone an elongated gas generating apparatus comprising:

a lower packer attached to a first end of said apparatus;

an upper packer attached to a second end of said apparatus;

an electrolyte containment sleeve extending intermediate said first end and said second end;

at least one elongated electrolysis cell disposed within said sleeve, said cell capable of producing at least one gas by electrolysis of an aqueous electrolyte retained within said sleeve;

a gas releasing means affixed to or present within said sleeve allowing said gas or gases to be discharged from said sleeve into said drilled borehole; and a multipurpose suspension cable attached to said second end of said apparatus for supplying electrical power for electrolysis and for operation of said packers and for supplying hydraulic fluid or compressed air to said packers;

inflating said lower packer via a connection to a supply source for inflatinq said packers via said multipurpose suspension cable;

first running an electrical current to said electrolysis cell through said multipurpose suspension cable for a period of time to produce a preliminary amount of gas in the sleeve;

inflating said upper packer via a connection to a supply source for inflating said packers via said multipurpose suspension cable; and continuing to run said electrical current to said electrolysis cell for a period of time to generate additional gas or gases for discharge within said borehole.

11. The method of claim 10, wherein said cell is capable of producing a stoichiometric mixture of combustible gases and said apparatus further comprising at least one ignition means for igniting said mixture of said gases.

12. The method of claim 11, wherein said electrolyte containment sleeve contains a plurality of said elongated electrolysis cells and a plurality of said ignition means in an alternating sequence.

13. The method of claim 12, wherein each of said electrolysis cells contains a plurality of cascaded metal electrodes.

14. The method of claim 11, wherein said ignition means is disposed within said sleeve.

15. The method of claim 11 wherein said gas releasing means of said apparatus is at least one disrupter affixed to the surface of said sleeve for breaking the structural integrity of said electrolyte containment sleeve and further comprising the step of initiating activation of said disrupter to break the structural integrity of said electrolyte containment sleeve via a connection to said electrical power through said multipurpose suspension cable after said first running of said electrical current to said electrolysis cell.

16. The method of claim 15, wherein said period of time to generate additional gas or gases is long enough to accumulate a sufficient quantity of said stoichiometric mixture of combustible gases to fracture said zone and further comprising the step of igniting said sufficient quantity of said stoichiometric mixture of combustible gases using said ignition means activated by said electrical power to cause an explosion in said zone of said drilled borehole.

17. The method of claim 11, wherein said gas releasing means of said apparatus is a centrally located perforated gas collection tube extending longitudinally through the entire length of said electrolyte containment sleeve and extending out of the end of said sleeve adjacent to said second end of said apparatus and wherein said stoichiometric mixture of combustible gases collects in and rises to the end of said perforated gas collection tube adjacent to said second end of said apparatus and passes out of said tube into said drilled borehole.

18. The method of claim 17, wherein said electrolysis cell contains a plurality of cascaded metal electrodes.

19. The method of claim 18, wherein said first running of said electric current is for a period of time sufficient to purge said drilled borehole of preexisting gases.

20. The method of claim 17, wherein said period of time to generate additional gas or gases is long enough to accumulate a sufficient quantity of said stoichiometric mixture of combustible gases to fracture or to enhance the permeability of said zone when ignited and further comprising the step of igniting said sufficient quantity of said stoichiometric mixture of combustible gases using said ignition means activated by said electrical power to cause an explosion in said zone of said drilled borehole.

21. The method of claim 20, wherein said method is repeated for a number of times sufficient to achieve a desired permeability of the zone of said drilled borehole.

22. The method of claim 10, wherein said gas releasing means of said apparatus is a centrally located perforated gas collection tube extending longitudinally through the entire length of said electrolyte containment sleeve and extending out of the end of said sleeve adjacent to said second end of said apparatus and wherein said gas or gases collect in and rise to the end of said perforated gas collection tube adjacent to said second end of said apparatus and passes out of said tube into said drilled borehole.

23. The method of claim 22, wherein said electrolysis cell contains a plurality of cascaded metal electrodes.

24. The method of claim 22, wherein said period of time to generate additional gas or gases is long enough to accumulate a sufficient quantity of gas or gases for delivery to the zone of said borehole and further comprising the step of delivering said gas or gases to said zone.

25. The method of claim 24, further comprising the step of delivering said gases to said zone by pressurized air delivered into said drilled borehole.

26. The method of claim 10, wherein said electrolysis cell contains a plurality of cascaded metal electrodes alternating with gas separating membranes, and said gases are separated with said gas separating membranes and said gas releasing means is two adjacent parallel centrally located perforated gas collection tubes allowing said separated gases to flow separately through said tubes.

* * * * *